US007661218B2

(12) United States Patent
Pikielny

(10) Patent No.: US 7,661,218 B2
(45) Date of Patent: Feb. 16, 2010

(54) FIREARM WITH ON-OFF SAFETY SWITCH

(76) Inventor: Dov Pikielny, 7 Dov Hoz Street, Herzliya 46581 (IL)

( * ) Notice: Subject to any disclaimer, the term of this patent is extended or adjusted under 35 U.S.C. 154(b) by 115 days.

(21) Appl. No.: 11/672,073

(22) Filed: Feb. 7, 2007

(65) Prior Publication Data

US 2008/0110075 A1 May 15, 2008

(51) Int. Cl.
*F41A 17/00* (2006.01)

(52) U.S. Cl. ..... 42/70.01; 42/1.01; 42/1.05

(58) Field of Classification Search ..... 42/1.01, 42/1.05, 70.01
See application file for complete search history.

(56) References Cited

U.S. PATENT DOCUMENTS 4,541,191 A * 9/1985 Morris et al. ..... 42/1.01
4,793,085 A * 12/1988 Surawski et al. ..... 42/84
4,934,086 A * 6/1990 Houde-Walter ..... 42/115
5,005,307 A * 4/1991 Horne et al. ..... 42/1.02
5,016,378 A * 5/1991 Sain ..... 42/70.06
5,052,138 A * 10/1991 Crain ..... 42/1.02
5,068,969 A 12/1991 Siebert
5,142,805 A * 9/1992 Horne et al. ..... 42/1.02
5,303,495 A * 4/1994 Harthcock ..... 42/84
5,531,040 A * 7/1996 Moore ..... 42/115
5,694,713 A * 12/1997 Paldino ..... 42/115
5,896,691 A * 4/1999 Kaminski et al. ..... 42/70.11
5,946,840 A 9/1999 Mickel
6,094,850 A * 8/2000 Villani ..... 42/1.02
2006/0026886 A1* 2/2006 Doukas ..... 42/117
2007/0186457 A1* 8/2007 Pitt ..... 42/70.06
2008/0110075 A1* 5/2008 Pikielny ..... 42/70.01

* cited by examiner

*Primary Examiner*—Troy Chambers
*Assistant Examiner*—Samir Abdosh
(74) *Attorney, Agent, or Firm*—Dekel Patent Ltd; David Klein

(57) ABSTRACT

Firearm that includes a safety that doubles as an on-off switch for electrical accessories.

1 Claim, 1 Drawing Sheet

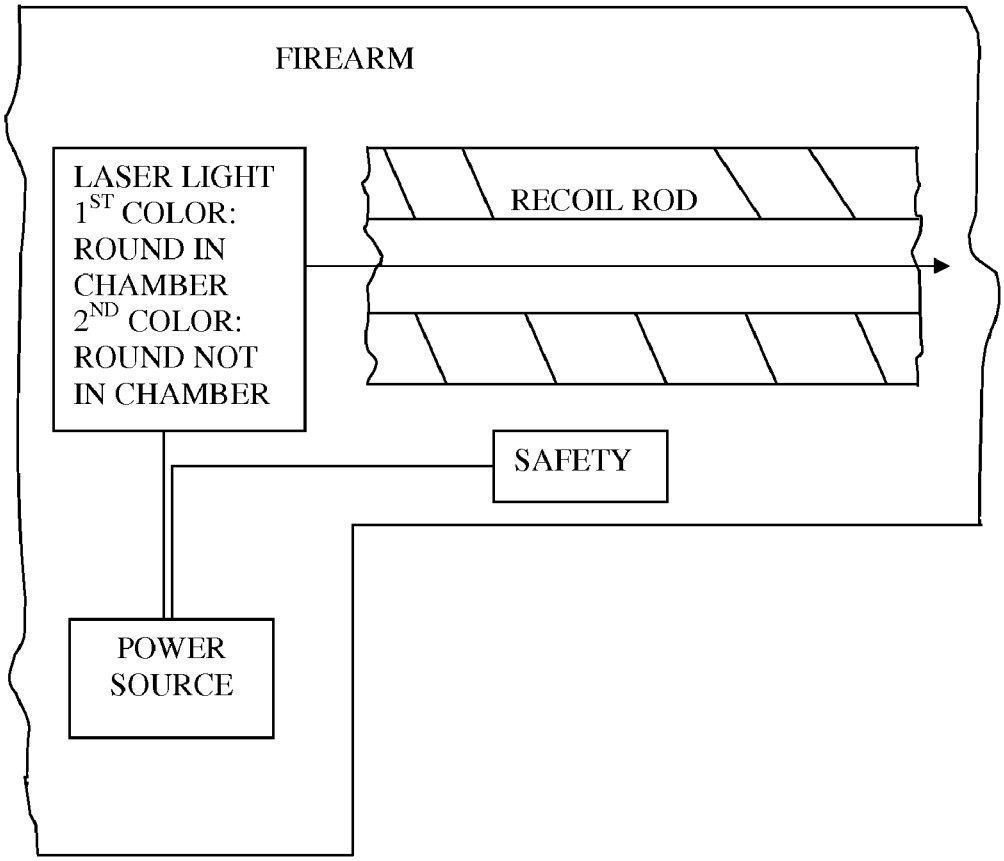
FIREARM
LASER LIGHT
1ST COLOR:
ROUND IN
CHAMBER
2ND COLOR:
ROUND NOT
IN CHAMBER
RECOIL ROD
SAFETY
POWER
SOURCE

FIREARM WITH ON-OFF SAFETY SWITCH

FIELD OF THE INVENTION

The present invention relates generally to firearms, and particularly to firearms wherein the safety doubles as an on-off switch for electrical accessories.

BACKGROUND OF THE INVENTION

U.S. Pat. No. 4,934,086 to Houde-Walter describes a recoil spring guide mounting for a laser sight. A laser sight for a firearm has a recoil spring guide. Components are mounted on the spring guide so that a light beam is directed along the axis of the spring guide. This automatically makes the light beam parallel with the barrel of the firearm.

U.S. Pat. No. 5,509,226 to Houde-Walter describes a laser sight having a power source disposed substantially entirely within the recoil spring guide chamber of a firearm, such as the recoil cavity of a pistol. The laser sight is itself contained in an elongated housing having at one end a window through which a laser beam is emitted and at the other end a battery cap.

U.S. Pat. No. 5,179,235 to Toole describes a laser sighting device for a pistol includes a universally mounted laser diode at the forward end of the pistol's trigger guard, wherein positioning of the laser beam is accomplished via adjustment screws from within the trigger guard. An energizing cable in the pistol structure is connected to a power supply located within the pistol's handgrip, and an externally operable activating switch is provided at the rear of the handgrip which is easily actuated by the user's hand immediately before the trigger is operated. The switch means is operable by pressure from the hand of the user between thumb and forefinger as the user's forefinger is inserted through the trigger guard.

SUMMARY OF THE INVENTION

The present invention seeks to provide a firearm wherein the safety doubles as an on-off switch for electrical accessories, as is described more in detail hereinbelow.

There is thus provided in accordance with an embodiment of the present invention a firearm with a safety that moves between a safe position that does not permit firing of the firearm and a fire position that permits firing of the firearm, wherein the safety is in electrical communication with a power source and the switch serves as an electrical switch for switching power from the power source to an electrically activated component of the firearm.

The safety may include an active safety that must be moved to the fire position by an action independent of gripping the firearm, pulling a trigger and firing a projectile from the firearm. For example, the safety may include a pivoting lever on a side of the firearm, the lever being connected to an electrical switch with electrical contacts, wherein in a safe mode the switch is in an off position, and in a fire mode the switch is in an on position with electrical connection being made between the power source and the electrically activated feature of the firearm via one of the electrical contacts.

Alternatively, the safety may include a grip safety that is moved to the fire position by properly squeezing a grip of the firearm, wherein in the fire position electrical contact is made between the power source and the electrically activated feature of the firearm via an electrical contact. As another alternative, the safety may include a trigger safety that is moved to the fire position by squeezing the trigger safety in a same direction of pulling a trigger of the firearm, wherein in the fire position electrical contact is made between the power source and the electrically activated feature of the firearm via an electrical contact.

The electrically activated feature of the firearm may include a laser light indicator, wherein when the safety moves to the fire position, the laser light indicator emits a first color laser beam if a round is loaded in a chamber of the firearm, and the laser light indicator emits a second color laser beam if a round is not loaded in the chamber of the firearm.

The electrically activated feature of the firearm may include an internal laser device integrated as an internal module in the firearm. The internal laser device may emit a laser beam that passes through a recoil rod of the firearm.

BRIEF DESCRIPTION OF THE DRAWINGS

The present invention will be understood and appreciated more fully from the following detailed description, taken in conjunction with the drawing which is a simplified illustration of a firearm with an on/off safety switch, constructed and operative in accordance with an embodiment of the present invention.

DETAILED DESCRIPTION OF EMBODIMENTS

The present invention is applicable for integrated laser devices, illuminating devices or any other electrically activated appliance on a firearm. The devices may or may not be parallel to the firearm, but do not interfere with the firearm mechanism. The present invention is applicable for individually operated firearms, such as but not limited to, handguns (e.g., pistols, revolvers, etc.), rifles (e.g., sniper rifles, semi-automatic rifles, fully automatic rifles, shot guns, assault rifles) and other types of firearms.

It is well known in the art to provide firearms, such as handguns, with one or more safeties. Some safeties are opened to permit firing the firearm simply by following correct firing procedures. For example, a well known trigger safety includes a second type of trigger that is squeezed together with the firing trigger during normal, safe operation of the firearm. Likewise, a grip safety is opened when the firearm is properly gripped by the user. Such safeties will be referred to herein as passive safeties.

There are other safeties that must be opened by means of some action independent of the action of simply gripping the firearm, pulling the trigger and firing a projectile from the firearm. An example is a thumb-actuated safety or simply thumb safety, e.g., a knob or lever that must be moved by a thumb or other finger to permit firing the firearm. Such safeties will be referred to herein as active safeties.

In one embodiment of the present invention, the firearm is an electrically powered firearm, which may be constructed from wood, metal, polymer, composite materials, etc., or which may be integrated with semiconductor materials or other material(s). The firearm may have an electrical connection between the power source and the trigger and/or the trigger safety to a main safety/on-off switch or any other device that can prevent or allow the mechanism to be used. In other words, the safety (passive safety or active safety, such as grip safety, trigger safety, thumb safety, etc.) may double as an on-off switch for electrical accessories. For example, in the case of a thumb safety that includes a pivoting lever on a side or sides of the firearm, the lever may be connected to an electrical switch with electrical contacts. In the safe mode, the switch is in the off position. In the fire mode, the switch is in the on position with electrical connection being made via the electrical contact between the power source and any electrically activated feature of the firearm, such as but not limited to an electrically activated firing mechanism. (For example, a hammer that strikes an electrical power source. The force from the hammer causes electrical energy to flow from the electrical power source to an electrically activated primer, thereby igniting the primer.) Similarly, in the case of a grip or trigger safety, the grip or trigger safety may have two electrical contacts and squeezing the grip or trigger safety switches to the "on" contact (similarly to squeezing the trigger of an electrical drill).

Accordingly, the safety can allow or prevent an action to fire a projectile from the firearm (e.g., pulling the trigger or the firing pin igniting the primer), and the same safety is used as a main switch for the power source/key board for the activation or deactivation of any other electrically activated features of the firearm.

According to the particular need, the power connection or other electrical portions of the gun may be wired from the front to the back end, or from the top to bottom end.

The power source can be an internal battery, interchangeable, external battery or a re-chargeable battery that can be attached to external connectors. Another possibility is a battery that is integrated into the magazine, such as in U.S. Pat. No. 7,032,342 to Dov Pikielny, the disclosure of which is incorporated herein by reference.

The user may switch the passive or active safety from "safe mode" to "fire mode" in order to turn it into the "on" position. Thus, in the case of a passive safety, such as a grip safety, the user may squeeze the grip safety in order to turn the weapon to the electrical "on" position, while simultaneously switching the safety to fire mode. Likewise, in the case of an active safety, such as a thumb safety, the user may push the thumb safety lever to the fire mode, which simultaneously turns the weapon to the electrical "on" position.

The following is a non-limiting example of operation of the firearm with a trigger safety. It is appreciated that the features mentioned in this example may also be used with other passive or active safeties.

i. Once the gun is cocked and a round is loaded in the chamber, an indicator may turn on a red laser mounted on or in any suitable portion of the firearm. A laser beam will be shot (emitted by the laser) once the trigger safety is squeezed and before the trigger itself is squeezed. There is no need to move the trigger itself in order to emit the laser beam.

ii. Once the trigger safety is squeezed and a round is loaded in the chamber, a sight (mounted on or in any suitable portion of the firearm) turns red. If there is no ammunition in the chamber, the sights turn green. The sight may be a fiber optic sight.

iii. Once the gun is fired, in case another round is not chambered immediately thereafter, the laser is switched to green while the round in the chamber indicator drops down.

Other non-limiting features of the invention include, but are not limited to:

a. An internal laser device whose modules are integrated as internal module in the firearm (not like LASER MAX® or CRIMSON TRACE®, which are external modules). The laser beam may pass through the recoil rod, which means that the entire recoil rod is hollow, but is not a part of the recoil rod like LASER MAX® LMS-4XD40 internal laser sight. In other words, the rod is like a tunnel for the laser beam to travel through.

b. There may be two colored lasers; one red, when the gun is loaded with live ammunition, and one green for training purposes. The selection between the red and green laser may be made with an electrical switch, integrated with the "round in the chamber indicator" (e.g., the round-in-the-chamber indicator in Springfield Armory XD models). When the indicator is up (i.e., the round is loaded in the chamber) the red laser works; when the indicator is down (no round in chamber) the green laser works.

c. "Loaded"/"Unloaded" sight indicator, which may include a fiber optic rear sight, which can change color from red to green and vice versa in order to indicate/provide feedback to the shooter whether the gun is loaded or is not.

d. A rheostat or other control device may be provided that allows making the sight brighter or dimmer for day/night vision/or bright direct sun, etc. (controls brightness of the internal laser device).

It will be appreciated by persons skilled in the art that the present invention is not limited to what has been particularly shown and described hereinabove. Rather, the scope of the present invention includes both combinations and subcombinations of the various features described hereinabove, as well as variations and modifications thereof that are not in the prior art, which would occur to persons skilled in the art upon reading the foregoing description.

What is claimed is:

1. An article comprising:

a firearm with a safety that moves between a safe position that does not permit firing of the firearm and a fire position that permits firing of the firearm, wherein said safety is in electrical communication with a power source and said safety serves as an electrical switch for switching power from said power source to an electrically activated component of the firearm, wherein said electrically activated component of the firearm comprises a laser light indicator, wherein when said safety moves to the fire position, said laser light indicator emits a first color laser beam if a round is loaded in a chamber of the firearm, and said laser light indicator emits a second color laser beam if a round is not loaded in the chamber of the firearm, and wherein said first and second color laser beams pass through a recoil rod of the firearm, and wherein said recoil rod has a hollow tunnel for the laser beams to travel through.

* * * * *